US011286107B2

(12) United States Patent
Harakal

(10) Patent No.: US 11,286,107 B2
(45) **Date of Patent: *Mar. 29, 2022**

(54) WASTE DISPOSAL SYSTEM

(71) Applicant: Michael J. Harakal, Naples, FL (US)

(72) Inventor: Michael J. Harakal, Naples, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/549,374

(22) Filed: Aug. 23, 2019

(65) Prior Publication Data

US 2019/0375584 A1 Dec. 12, 2019

Related U.S. Application Data

(63) Continuation of application No. 15/374,625, filed on Dec. 9, 2016, now Pat. No. 10,399,771.

(60) Provisional application No. 62/368,427, filed on Jul. 29, 2016.

(51) Int. Cl.

| | |
|---|---|
| ***B65F 1/12*** | (2006.01) |
| ***B65F 1/06*** | (2006.01) |
| ***B65F 1/14*** | (2006.01) |
| ***B65F 1/16*** | (2006.01) |

(52) U.S. Cl.

CPC ..... *B65F 1/125* (2013.01); *B65F 1/06* (2013.01); *B65F 1/068* (2013.01); *B65F 1/141* (2013.01); *B65F 1/1646* (2013.01); *B65F 1/16* (2013.01); *B65F 2210/1026* (2013.01); *B65F 2210/13* (2013.01); *B65F 2210/132* (2013.01); *B65F 2210/148* (2013.01); *B65F 2210/181* (2013.01); *B65F 2240/136* (2013.01); *B65F 2250/11* (2013.01); *B65F 2250/114* (2013.01)

(58) Field of Classification Search

CPC .. B65F 1/06; B65F 1/068; B65F 1/141; B65F 1/1646; B65F 1/16; B65F 2210/1026; B65F 2210/13; B65F 2210/132; B65F 2210/148; B65F 2210/181; B65F 2240/136; B65F 2250/11; B65F 2250/114

USPC ..... 220/495.07, 495.08, 495.05

See application file for complete search history.

(56) References Cited

U.S. PATENT DOCUMENTS

| | | | |
|---|---|---|---|
| 3,050,209 | A | 8/1962 | Germaine et al. |
| 4,211,750 | A | 7/1980 | Gillespie |
| 5,031,796 | A | 7/1991 | Schafer et al. |

(Continued)

FOREIGN PATENT DOCUMENTS

| | | |
|---|---|---|
| GB | 2360195 | 9/2001 |
| KR | 20140077030 | 6/2014 |
| KR | 101416772 | 7/2014 |

OTHER PUBLICATIONS

"DOGIPOT Pet Stations", http://www.dogipot.com/pet-stations, Jul. 8, 2016, 2 pages.

(Continued)

*Primary Examiner* — Shawn M Braden

(74) *Attorney, Agent, or Firm* — Duane Morris LLP; Gregory M. Lefkowitz

(57) ABSTRACT

A container including a plurality of side walls connected to form a tubular structure. A lid is provided for covering a top opening of the tubular structure. The lid includes a separate compartment with a bag dispenser therein, and the compartment is accessible for dispensing a bag while the lid is in contact a top edge of the tubular structure. A base is provided at or near a bottom opening of the tubular structure.

20 Claims, 22 Drawing Sheets

(56) References Cited

U.S. PATENT DOCUMENTS

| | | | | |
|---|---|---|---|---|
| 5,090,585 | A * | 2/1992 | Power | B65F 1/062 220/495.04 |
| D330,786 | S | 11/1992 | Edgar | |
| 5,540,351 | A * | 7/1996 | Luescher | B65F 1/062 220/495.07 |
| 5,690,247 | A | 11/1997 | Boover | |
| 6,000,571 | A | 12/1999 | Brooks et al. | |
| 6,126,031 | A | 10/2000 | Reason | |
| 6,170,692 | B1 | 1/2001 | Johnston | |
| 6,472,580 | B2 | 10/2002 | Kaye et al. | |
| 6,672,472 | B1 | 1/2004 | Rockwood et al. | |
| 6,761,130 | B1 | 7/2004 | Vicknair | |
| 7,273,155 | B1 | 9/2007 | Gray | |
| 7,401,708 | B2 | 7/2008 | Lin | |
| D624,714 | S | 9/2010 | Brochu | |
| 8,544,413 | B1 | 10/2013 | Gnanendran | |
| D710,555 | S | 8/2014 | Nattrass | |
| 8,910,821 | B1 | 12/2014 | Stravitz | |
| 8,944,274 | B2 | 2/2015 | Madrid | |
| 8,955,706 | B2 | 2/2015 | Gagnebin | |
| 9,033,382 | B2 | 5/2015 | Hollett et al. | |
| 10,518,971 | B2 * | 12/2019 | Butler | B65F 1/002 |
| 2003/0029881 | A1 * | 2/2003 | Trunsky | B65F 1/062 221/45 |
| 2006/0163257 | A1 | 7/2006 | Golbert | |
| 2006/0243635 | A1 * | 11/2006 | Sullivan | A61B 17/3217 206/571 |
| 2007/0228046 | A1 | 10/2007 | Bastioli et al. | |
| 2007/0272694 | A1 | 11/2007 | May et al. | |
| 2008/0006638 | A1 | 1/2008 | Yang et al. | |
| 2008/0264949 | A1 | 10/2008 | Hume | |
| 2009/0230131 | A1 | 9/2009 | McDuffie et al. | |
| 2009/0302041 | A1 | 12/2009 | Wolfson et al. | |
| 2010/0032431 | A1 | 2/2010 | Schatz | |
| 2011/0056941 | A1 * | 3/2011 | Ohnishi | B65F 1/062 220/254.9 |
| 2011/0284544 | A1 | 11/2011 | Davies et al. | |
| 2015/0021332 | A1 | 1/2015 | Autumn | |
| 2015/0034665 | A1 | 2/2015 | Goldstein et al. | |
| 2016/0137411 | A1 | 5/2016 | Rogers | |

OTHER PUBLICATIONS

"Belson Outdoors, DOGIPOT(R) Pet Station | Polyethylene Plastic", http:www.belson.com/POLY-DOGIPOT-Pet-Station, Jul. 8, 2016, 3 pages.

* cited by examiner

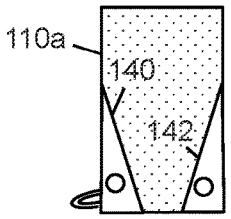
FIG. 27
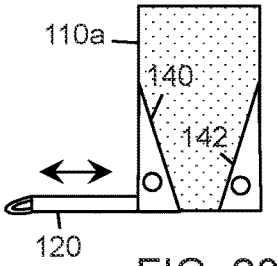
FIG. 28
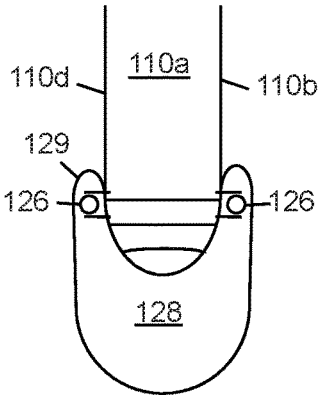
FIG. 29
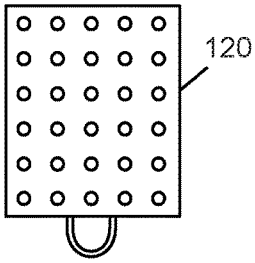
FIG. 30
FIG. 31
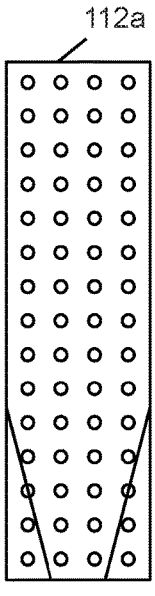
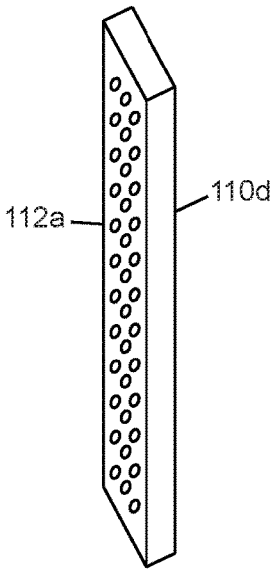
FIG. 32
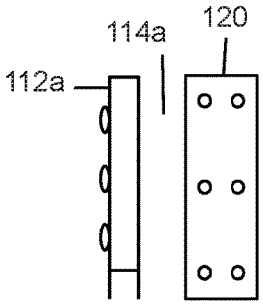
FIG. 33

WASTE DISPOSAL SYSTEM

This application is a continuation of U.S. application Ser. No. 15/374,625, filed Dec. 9, 2016, which claims the benefit of U.S. Provisional Patent Application No. 62/368,427, filed Jul. 29, 2016, the content of which are relied upon and incorporated herein by reference in their entireties.

FIELD

This disclosure relates generally to waste disposal containers.

BACKGROUND

If consumers are able to keep their garbage cans outside their home, many dispose of pet waste or other biomass or malodorous waste in garbage cans. Some consumers are unable to store garbage cans outside of their homes (e.g., due to condo/apartment or home owner association restrictions). In those cases, consumers may keep garbage cans in their garage or inside their dwelling unit. Over time, the trapped (removed pet) waste in the garbage cans emits an unpleasant odor.

SUMMARY

In some embodiments, a container comprises a plurality of outer side walls connected to form a tubular structure. One or more permeable inner walls are near respective ones of the plurality of outer walls, defining a respective space between each inner wall and its respective adjacent outer wall. A lid (which can be vented or non-permeable) is provided for covering a top opening of the tubular structure. A removable base is provided at or near a bottom opening of the tubular structure.

In some embodiments, a container comprises a tubular structure having a non-permeable outer surface, the tubular structure having a tapered inner structure at a bottom thereof, at least one mount attached to the outer surface for attaching the container to a structure with the container located above a ground surface; a lid for covering a top opening of the tubular structure; and a removable base at or near a bottom opening of the tubular structure.

In some embodiments, a method comprises: storing waste in a container having non-permeable outer walls, a lid, at least one permeable inner wall and a removable base; continuously ventilating the container through the inner wall; and removing the base to empty the waste from a bottom of the container.

In some embodiments, a container comprises an outer container having four side walls and a bottom wall. At least one of the side walls of the outer container or the bottom wall of the outer container has a plurality of openings. A lid covers a top opening of the tubular structure. A removable inner container has four side walls and a bottom wall. At least one of the side walls of the inner container or the bottom wall of the inner container has a plurality of openings. The removable inner container is configured to seat inside the outer container with a first channel between each wall of the outer container and the corresponding wall of the inner container adjacent to it, and a second channel between the bottom wall of the outer container and the bottom wall of the inner container. The first channel is connected to the second channel.

In some embodiments, a container comprising a plurality of side walls connected to form a tubular structure is provided. The container further comprises a lid for covering a top opening of the tubular structure. The lid comprises a separate compartment with a bag dispenser therein, the compartment being accessible for dispensing a bag while the lid is in contact with a top edge of the plurality of side walls. The container further comprises a base at or near a bottom opening of the tubular structure.

In some embodiments, a container comprising a tubular structure having an outer surface is provided. The container further comprises at least one mount attached to the outer surface for attaching the container to a structure with the container located above a ground surface. The container further comprises a lid for covering a top opening of the tubular structure. The lid comprises a separate compartment with a bag dispenser therein, the compartment being accessible for dispensing a bag while the lid is in contact a top edge of the tubular structure. The container further comprises a base at or near a bottom opening of the tubular structure.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate one or more embodiment(s), and together with the description serve to explain principles and operation of the various embodiments.

BRIEF DESCRIPTION OF THE DRAWINGS

FIG. 27 schematically shows the base of the container sliding out to release the waste.

FIG. 28 schematically shows the base of the container sliding out to release the waste.

FIG. 29 shows a plastic shopping bag hanging from the bag holders of the container of FIG. 4.

FIG. 30 shows a perforated base.

FIG. 31 is a side view of the inside wall of the container of FIG. 7.

FIG. 32 is an isometric view showing the inner and outer walls of the container of FIG. 7.

FIG. 33 is an enlarged detail of a bottom view of the container.

DETAILED DESCRIPTION

Figure 1:
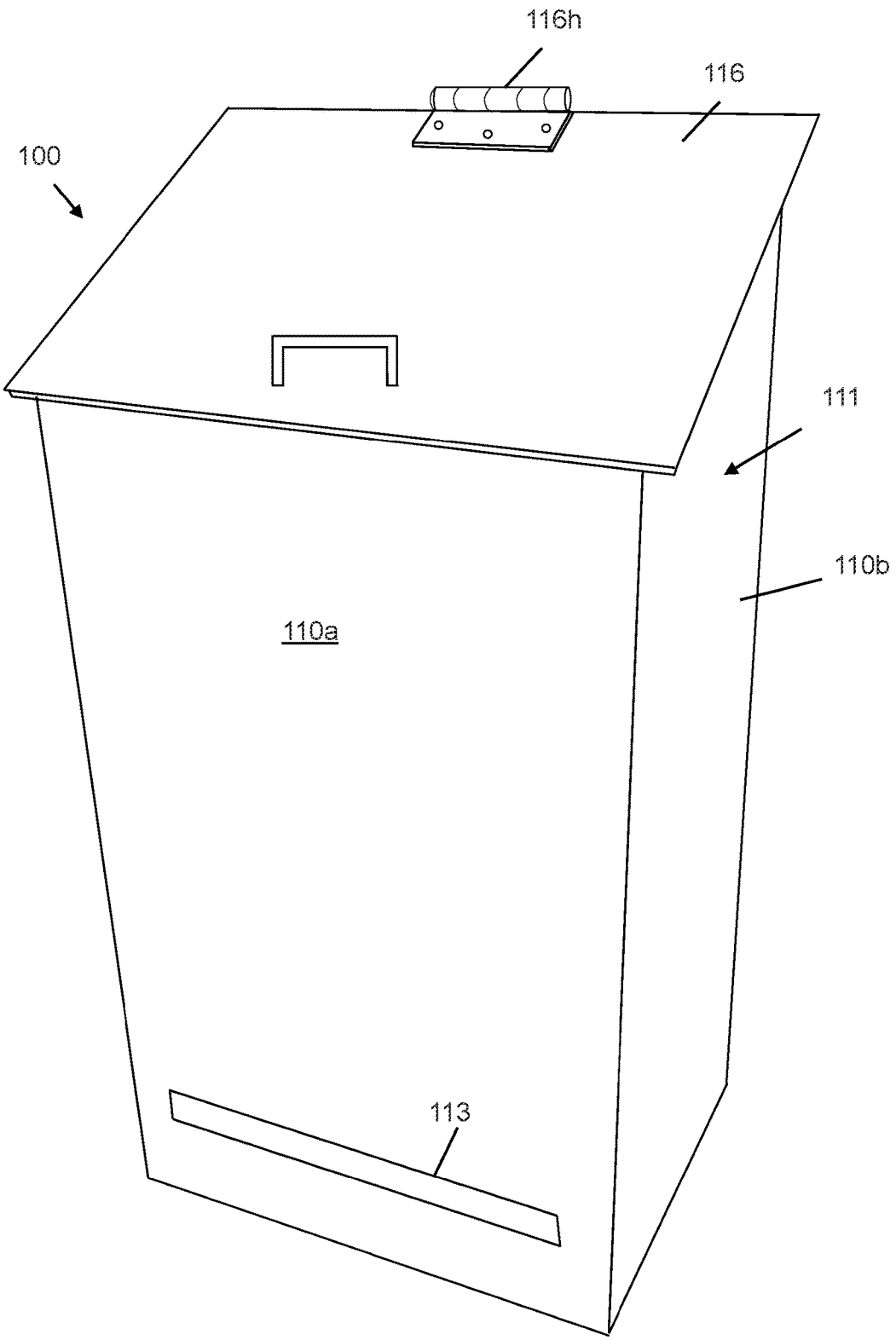
FIG. 1 is an isometric view of a waste container according to an exemplary embodiment.
Figure 2:
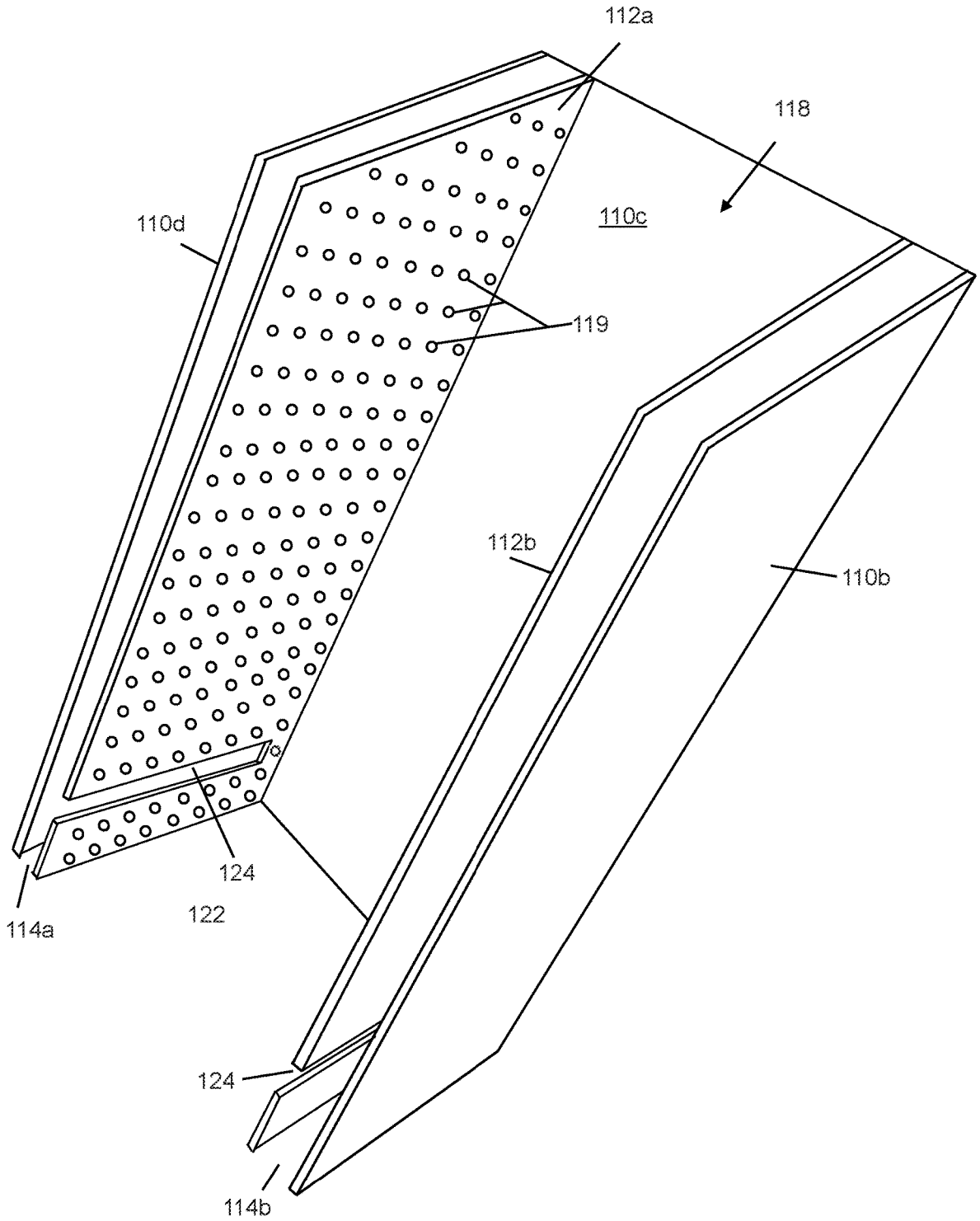
FIG. 2 is a cut-away view showing inner and outer side walls of the container of FIG. 1.
Figure 3:
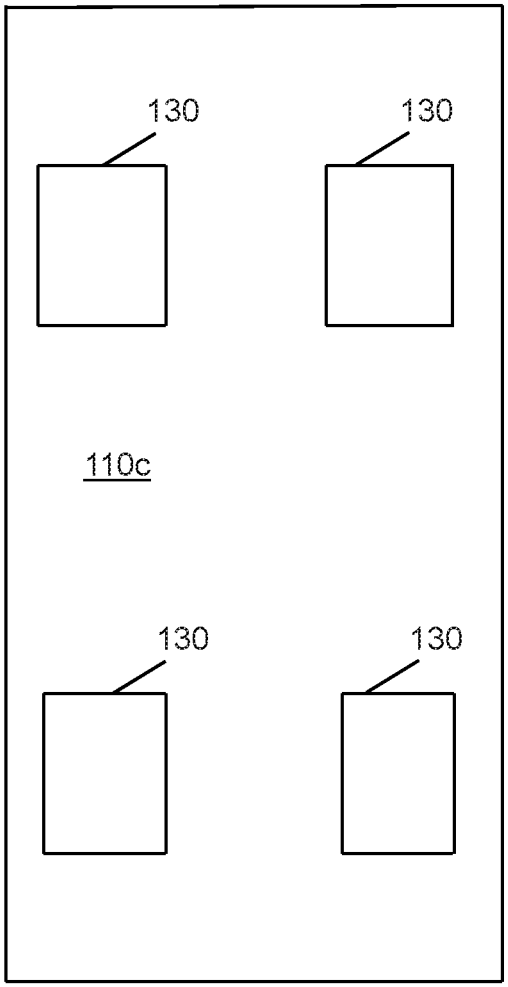
FIG. 3 is a rear view of the container of FIG. 1.
Figure 4:
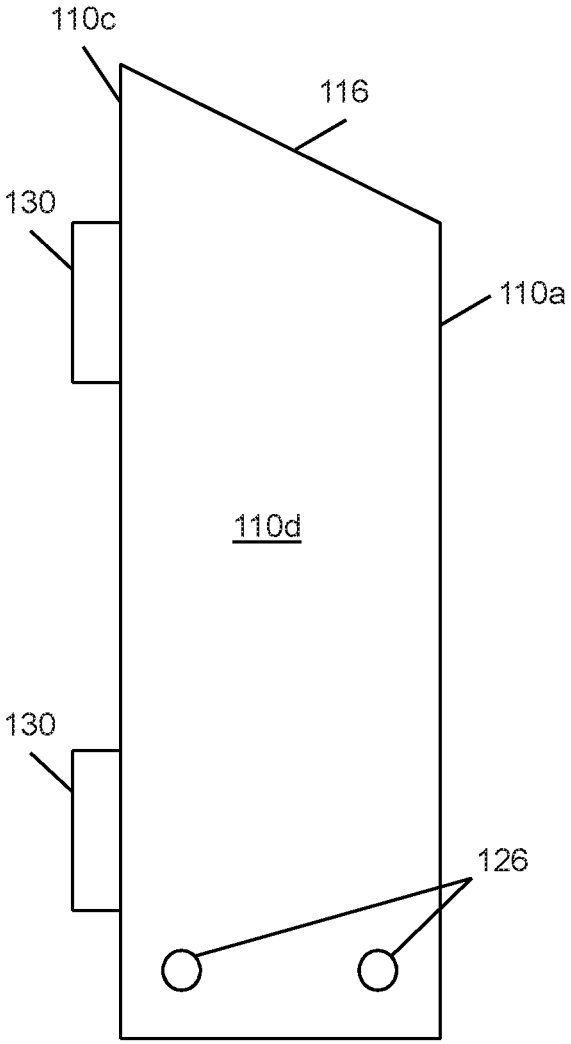
FIG. 4 is a left side view of the container of FIG. 1.
Figure 5:
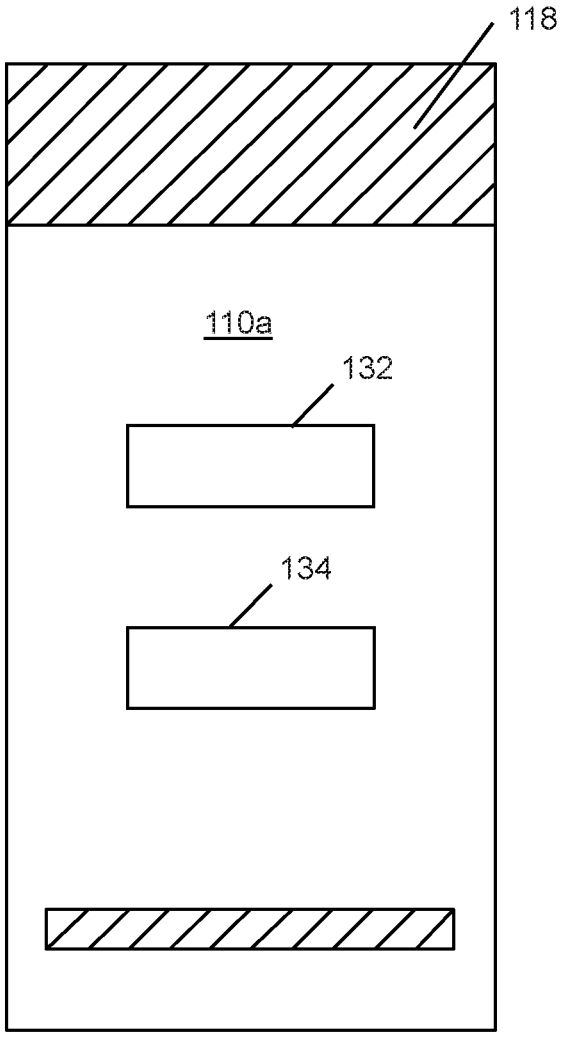
FIG. 5 is a front view of the container of FIG. 1.
Figure 6:
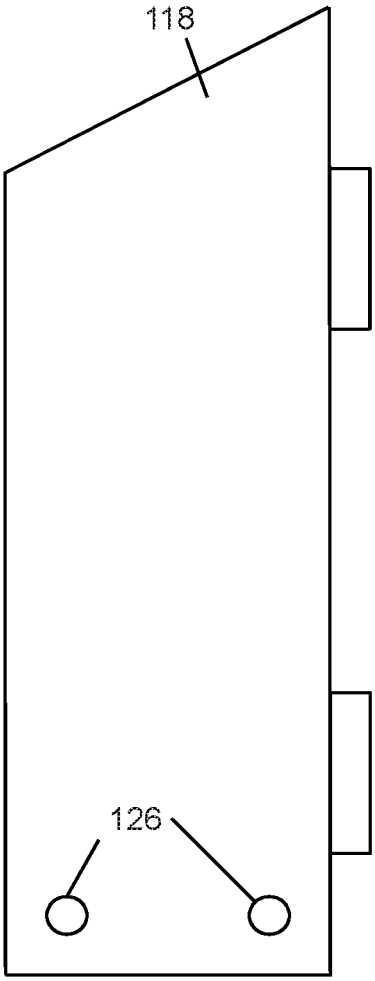
FIG. 6 is a right side view of the container of FIG. 1.
Figure 7:
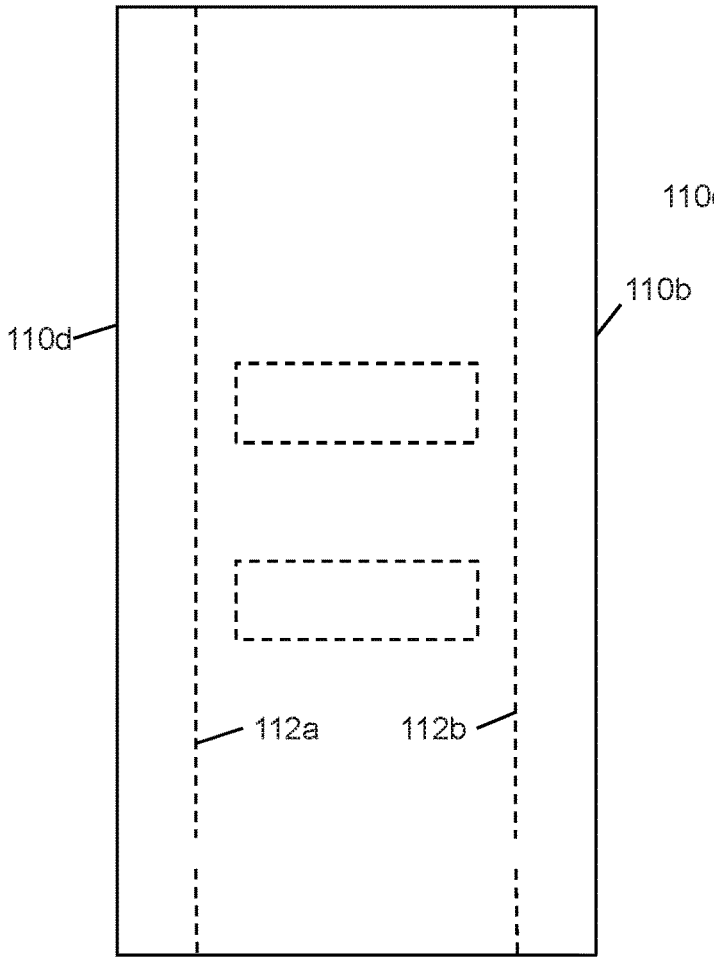
FIG. 7 is an interior view of the container of FIG. 1.
Figure 8:
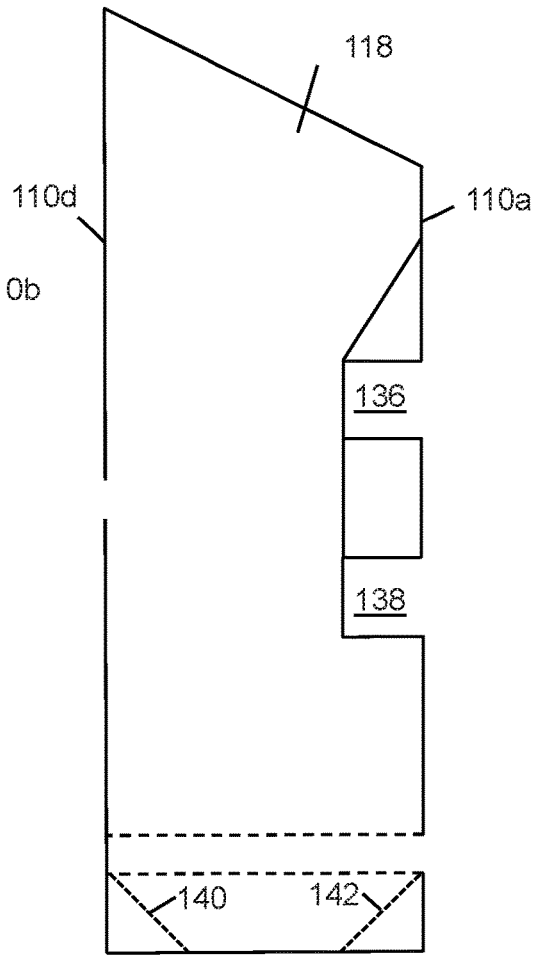
FIG. 8 is a left side interior view of the container of FIG. 1.
Figure 9:
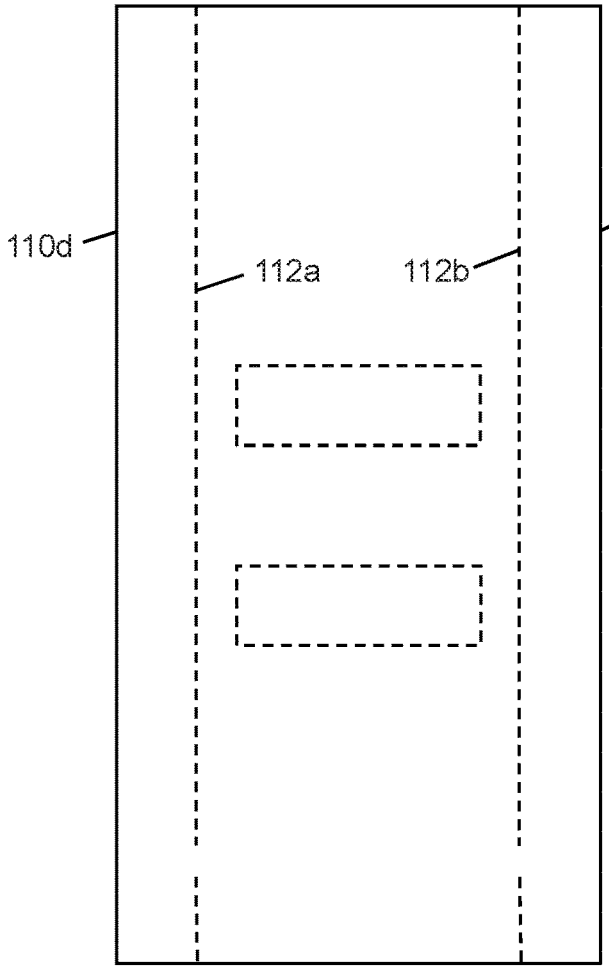
FIG. 9 is an interior view of the container of FIG. 1.
Figure 10:
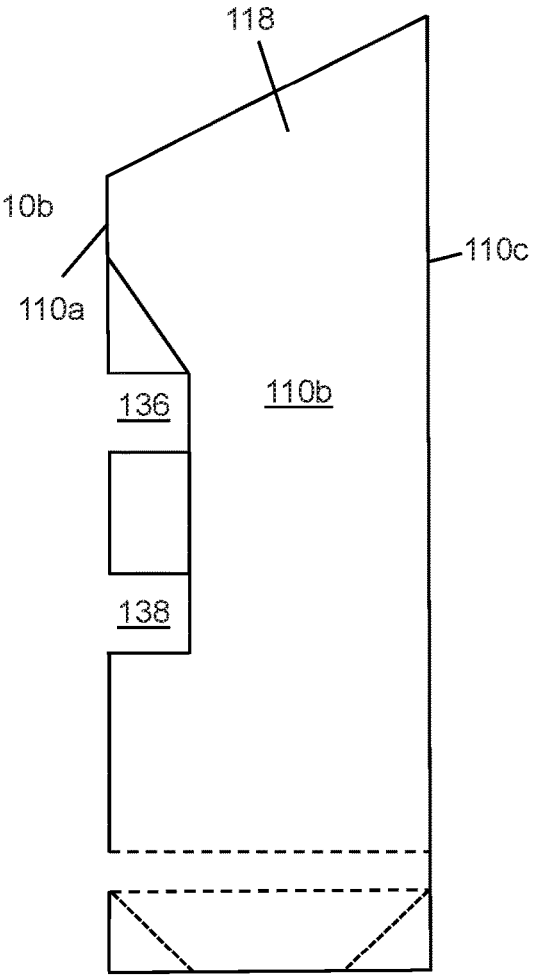
FIG. 10 is a right side interior view of the container of FIG. 1.
Figure 11:
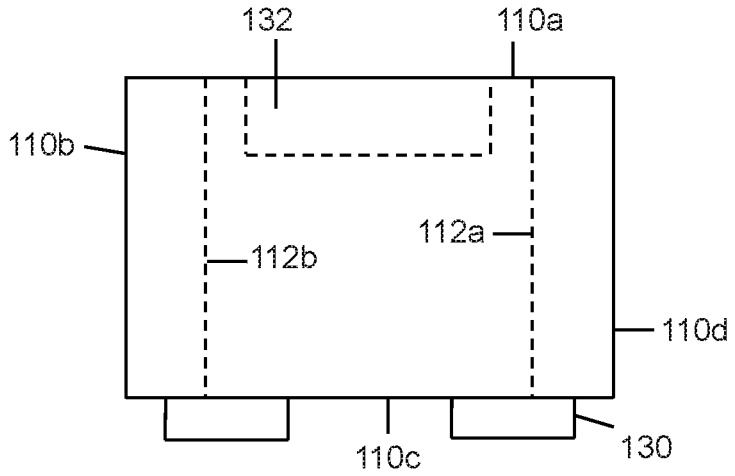
FIG. 11 is a top view of the container of FIG. 1.

This description of the exemplary embodiments is intended to be read in connection with the accompanying drawings, which are to be considered part of the entire written description. In the description, relative terms such as "lower," "upper," "horizontal," "vertical," "above," "below," "up," "down," "top," and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

This disclosure provides a single or double-walled container 100 or "garbage can" to temporarily hold bags of malodorous waste until the waste can be disposed of into a larger container. The can 100 may be mounted on a wall or on a stand or other raised man made or natural structures (e.g., tree) or, alternatively, the can may rest on the ground. The container 100 can also dispense waste bags and hold pet accessories.

FIGS. 1-12 show an exemplary container 100 according to some embodiments. In some embodiments, the container 100 comprises 4 parts: (1) the body or container tubular structure 111, (2) the lid 116, (3) the base 120 and (4) the mounting components 130. The first component of the design is a tubular structure 111, which can be a single or double-walled body. The body can be formed from any of a variety of materials, such as plastic, metal or a metal coated with a corrosion resistant material. The exterior walls 110*a*-110*d* of the body 111 are solid while the interior walls 112*a*, 112*b* are vented, creating at least one space 114*a*, 114*b* between the inner 112*a*, 112*b* and outer walls 110*a*-110*d*. The vents 119 (perforations or slots) also provide fluid drainage. In some embodiments, the spaces 114*a*, 114*b* are separated from each other. In other embodiments (not shown), the spaces 114*a*, 114*b* are connected to each other, by connecting passages (not shown) or additional spaces (not shown) between the outer walls 110*a*, 110*b* and additional ventilated inner walls (not shown).

The container 100 has an opening 118 to place bags of waste into the container at/near the upper end that can be covered by an attached or unattached lid 116. In some embodiments, the lid is attached. The lid can be attached by a variety of mechanisms, such as a hinge, hook and loop fasteners, tabs with matching slots, latches, or the like or alternatively rest on the upper surface of the container with or without a tapered interference fit or locking securement mechanism (not shown). In some embodiments, the hinge 116*h* comprises two interlocking components connected by a removable pin, so the lid 116 can be removed from the body 111. In some embodiments, the lid 116 overhangs and/or curves over the outer walls 110*a*-110*d* of the tubular container body 111. In some embodiments, the container's outer wall 110*a* has a cut-out 113 at or near the lower end on the front 110*a* or side 110*b* or 110*d*. The cutout 113 is configured to receive a slidably removable base 120.

Figure 12:
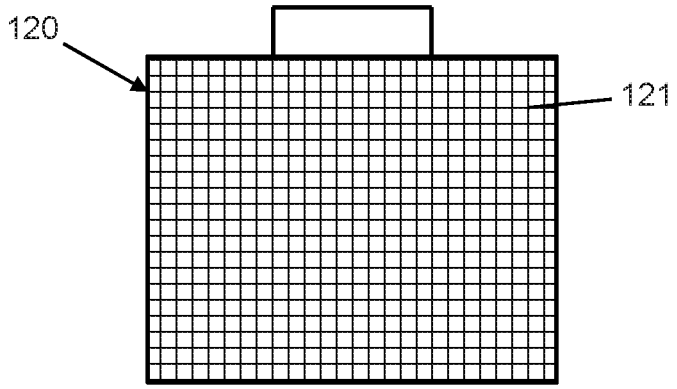
FIG. 12 is a top view of a base suitable for use in the container of FIG. 1.
Figure 13:
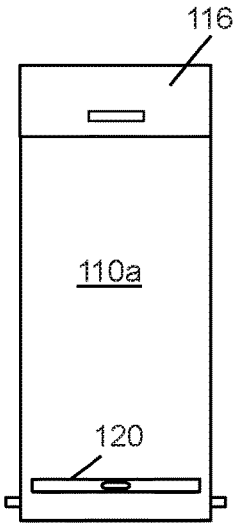
FIG. 13 is a front view showing an embodiment of the container having a removable base-tray and pegs for holding bags.
Figure 14:
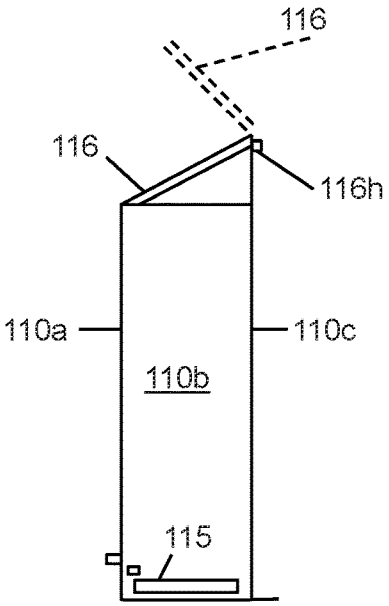
FIG. 14 is a side view of the container of FIG. 13.
Figure 15:
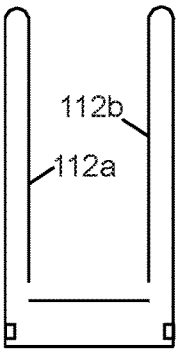
FIG. 15 is a schematic view showing the ventilation spaces in the container of FIG. 1 or FIG. 13.
Figure 24:
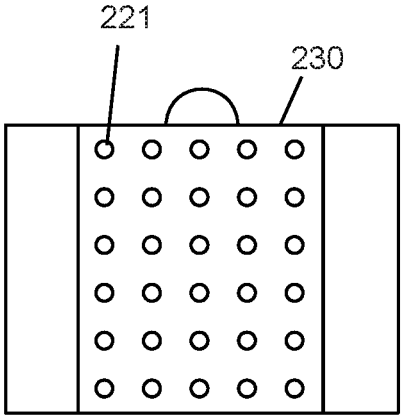
FIG. 24 shows a bottom view of the container of FIG. 1.
Figures 25, 26:
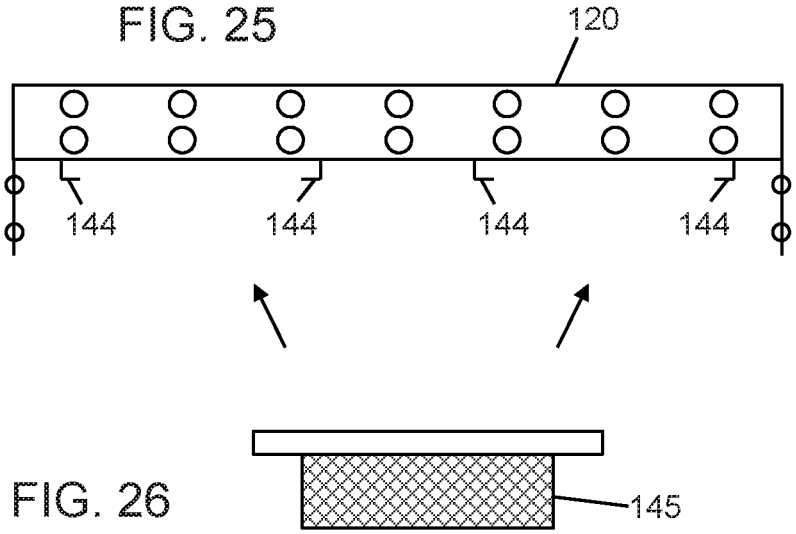
FIG. 25 schematically shows insertion of the deodorizing inserts into the holders of the base of FIG. 21B.
FIG. 26 schematically shows insertion of the deodorizing inserts into the holders of the base of FIG. 21B.

Inside some embodiments of the container 100, are cut-out slots 124 for a removable, base 120 to slide in or out of the container 100. In some embodiments, the base 230 is vented. In some embodiments, the base 230 can have slots or perforations (221, FIG. 24). In other embodiments, the base 120 can comprise a mesh or screen 121 (FIG. 12). The perforations, slots or mesh provide ventilation and liquid drainage. In other embodiments, the base is non-vented and non-permeable. When the base 120 slides out, the pet waste drops through the opening 122 in the lower part of the container 100. In some embodiments, one or more tapered interior walls 140, 142 facilitate waste sliding out the bottom 122 of the container 100 towards the center of the container's dimensions. In some embodiments, the base 120 is solid (non-permeable material without slots, perforations or other openings) and is removable for emptying waste from the bottom of the container 100.

In some embodiments, on the exterior of the container near the lower end 122 are protrusions, knobs or hangers 126 to hang a bag 128 below the container 100 during the emptying process. Two or more of the sides 110*a*-110*d* of the container 100 can have design elements such as hooks, pockets, webbing, platforms and/or ledges to hold pet accessories. An area 136, 138 of the exterior part of one of the outside walls 110*a* may contain a dispenser 132, 134 for (removed pet) waste bags.

Figure 34:
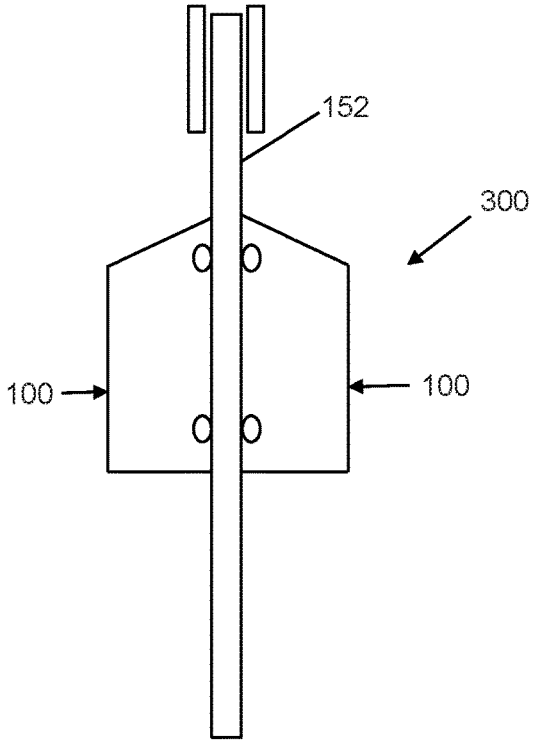
FIG. 34 is a side view showing two of the containers mounted back-to-back on a post.
Figure 35:
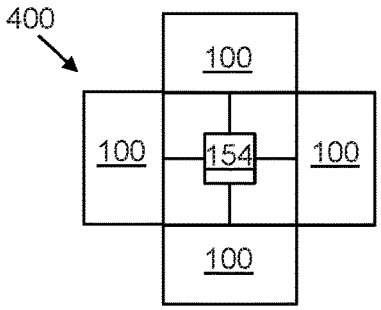
FIG. 35 is a top view showing four of the containers mounted 90 degrees apart from each other on a post.
Figure 36:
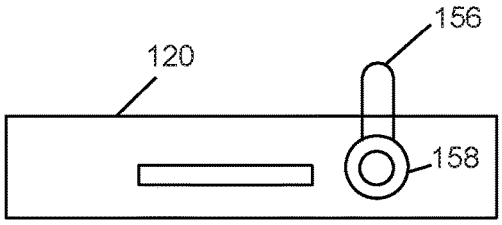
FIG. 36 is a front view of a base having a locking cam in the activated position.
Figure 37:
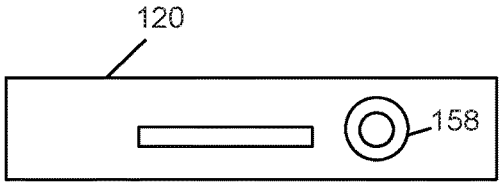
FIG. 37 is a front view of the base of FIG. 36, with the locking cam in the deactivated position.

The lid 116 protects the contents from rain and limits odors and insect infestation. The lid may be vented or non-permeable. A latch (not shown) may secure the lid 116 to the body 111. The container 100 can be mounted on a wall (not shown) or other raised man-made or natural structure (e.g., a tree or post). In other embodiments, the container 100 is mounted with an accessory stand, which can be a separate unit. FIG. 34 is a side view of a system 300 including a post 152, on which two of the containers 100 are mounted back-to-back. FIG. 35 is a top plan view of a system 400 including a post 154, on which four of the containers 100 are mounted. While the mounting brackets 130 remain fixed to the wall, post or stand, the container 100 can be removed, cleaned and reassembled back to the mounting brackets 130.

Figure 16:
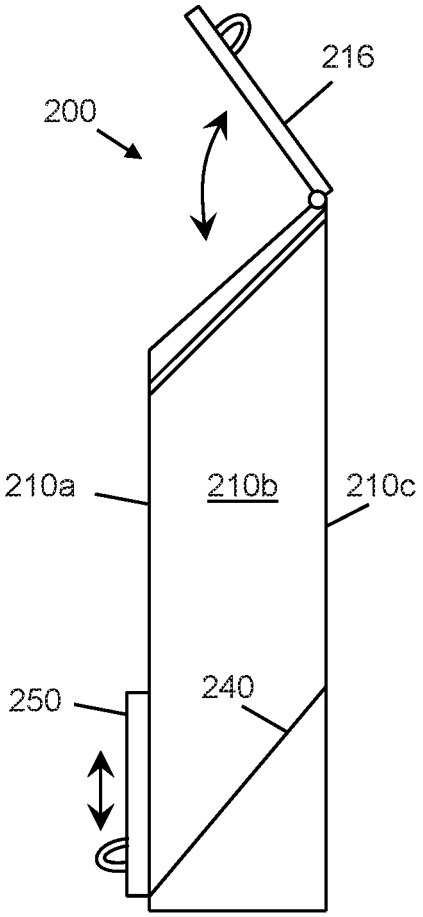
FIG. 16 is a side view of a container according to another embodiment.
Figure 17:
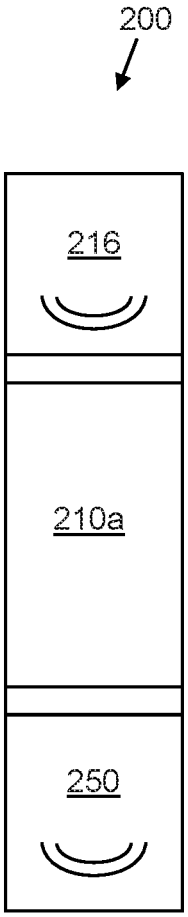
FIG. 17 is a front view of the container of FIG. 16, with the lid and door closed.
Figure 18:
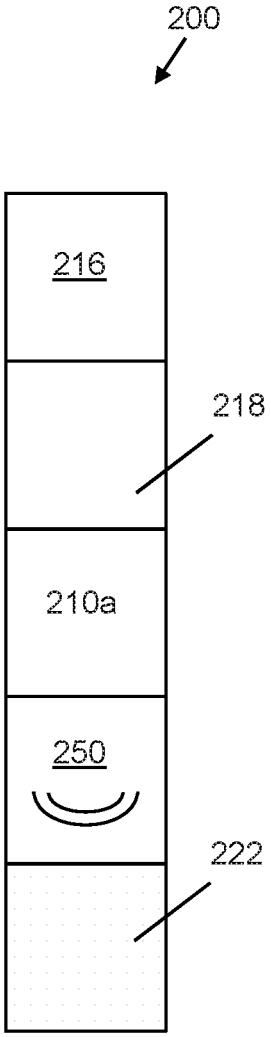
FIG. 18 is a front view of the container of FIG. 16, with the lid and door open.
Figure 19:
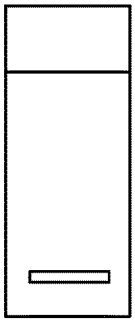
FIG. 19 is a front view of an embodiment of the container having a removable base.
Figure 20A:
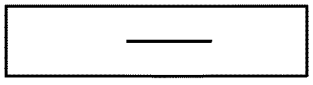
FIG. 20A is a front view of an embodiment of the base of FIG. 19.
Figure 20B:
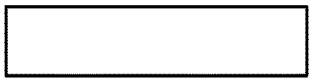
FIG. 20B is a rear view of an embodiment of the base of FIG. 19.
Figure 21A:
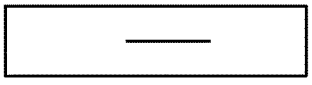
FIG. 21A is a front view of an embodiment of the base of FIG. 19 having deodorizing insert holders.
Figure 21B:
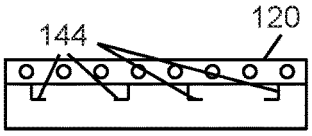
FIG. 21B is a rear view of an embodiment of the base of FIG. 19 having deodorizing insert holders.
Figure 21C:
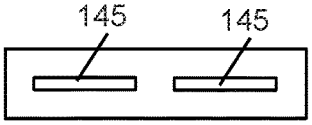
FIG. 21C shows the base of FIG. 21B with deodorizing inserts in the insert holders.

In the vented embodiment, the vented inner walls 112*a*, 112*b* (double wall construction) allow the waste to dry out and partially vent from underneath to minimize odors. The opening 118 at the upper end facilitates loading waste into the container 100. In some embodiments, the lid 116 overhangs the body 111 of the container to prevent any odors from leaking out and also to prevent any rainwater entering if the container is kept outside. In some embodiments, a latch (not shown) or other securement device prevents the lid 116 from blowing open if outdoor conditions are windy when the device is mounted outside. In some embodiments, the vented base 120 facilitates aeration. The slots 124 allow the base 120 to slide in and out of the cutout to facilitate emptying the container 100. In some embodiments, the tapered interior walls 140, 142 (FIG. 8) facilitate waste dropping out the middle of the container 100. In other embodiments, the tapered interior walls 240 facilitate waste dropping out the front back or sides (FIGS. 16-18). The exterior storage design and bag dispenser 132, 134 provide convenience for managing pet accessories. The mounting brackets 130 and/or stand 152 or 154 allow users who do not wish to affix the body 111 to a wall to still use the system. A Microban coating, if present, provides microbial resistance. The outer walls 110*a*-110*d* can have a variety of finishes which can include a standard exterior finish and color or a finish pre-primed and ready to paint as well as various surface textures.

In some embodiments, the tapered interior walls 140, 142 facilitate waste drop, and odor management inserts 145 manage odors. The device 100 can easily be removed from the post 152, 154 (by disconnecting the mounting brackets 130) and hosed off for cleaning, then re-mounted.

Some embodiments include the double walled body, the lid, and the base. Other components can be added.

The lid 116 can either be attached or unattached. The lid attachment mechanism 116*h* can vary in design. In some embodiments (not shown), the base 120 can be double-walled with perforations. In other embodiments, the base 120 has a single wall that slides in and out of a cut-out in the body 111. In some embodiments, the base 120 is solid (i.e., without perforations, slots or other openings). In some embodiments, instead of sliding in and out of slots 124 on the container 100, the base 120 can also be attached to the body and open or close. In some embodiments, the exterior of the body or lid may contain accessory hooks, knobs or protrusions 126. Some embodiments include hooks on the lid 116. Other embodiments omit the hooks.

In some embodiments, an all plastic construction can withstand the elements and prevent rusting. In some embodiments, the exterior of the container has slots 136, 138 configured to receive pre-loaded cartridges 132, 134 of eco-friendly pet waste bags, or a refillable bag dispenser.

In some embodiments, the body 111 can be provided in multiple sizes (lengths), with a variety of finishes (such as, but not limited to, plastic or pre-primed for painting) and textures. Some embodiments have an antimicrobial coating such as Microban or the like.

The system can also include scented and/or odor neutralizing bags 128 in the dispensers 132, 134, oxo- or biodegradable and/or earth friendly bags and/or a place to affix or insert an odor masking or neutralizing component 145 (FIGS. 21A-22C, 25, and 26).

In some embodiments, the device 100 is mountable, e.g., for personal use. Other embodiments for commercial designs can be made of metal (e.g., steel or aluminum) and mounted on a pole or raised man-made or natural structures, and may or may not include the odor management features 144, 145. In other embodiments, a user digs a hole beneath the container, and uses a material (e.g., sawdust, kitty litter, etc.) to manage pet waste as a composting material. In some embodiments, the plastic construction improves durability under different weather conditions and facilitates cleaning. The design provides a more sanitary way to handle pet or other odorous waste at home.

Although examples above use the container 100 to store pet waste, the container 100 can be used to store any malodorous contents, such as food waste.

The base 120 is able to withstand the downward pressure of the accumulated pet waste resting on it without warping. The entire system is able to withstand extreme weather and hot/cold temperatures. The mounting brackets 130 securely hold the device 100.

Semi-rigid plastic is a preferred material for the walls, lid and base in some embodiments. Exemplary materials can include, but are not limited to polyamide, polyurethane, polyethylene, polypropylene, polyvinyl chloride (PVC), acrylonitryl-butadiene-styrene (ABS), polycarbonate, chlorinated polyvinyl chloride (CPVC), an acrylic polymer and alumina trihydrate material sold as "CORIAN"® by the Dupont Corporation of Wilmington, Del., tetrafluoroethylene (TFE), or the like, or combinations of two or more of these materials. In other embodiments, the walls, lid and base can be made of metal, such as steel, stainless steel or aluminum. In other embodiments, these components comprise metal coated with plastic. In some embodiments, the components may include odor management technologies to either add fragrances to the polymers or to neutralize/absorb unwanted scents (e.g., Scentmaster Fragrance Technology).

Figure 22A:
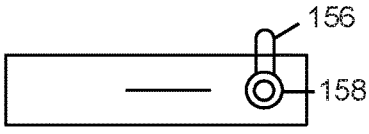
FIG. 22A is a front view of an embodiment of the base of FIG. 19 having deodorizing insert holders and a lock 156.
Figure 22B:
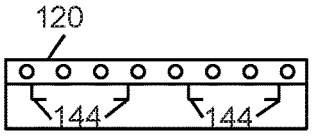
FIG. 22B is a rear view of an embodiment of the base of FIG. 19 having deodorizing insert holders and a lock 156.
Figure 22C:
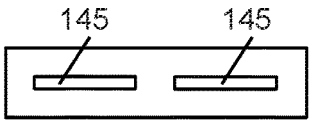
FIG. 22C shows the base of FIG. 22B with deodorizing inserts in the insert holders.

In some embodiments (FIGS. 22A-22C), the removable base 120 has a lock 156. In some embodiments, the lock 156 is a secure device, such as a padlock with a key to protect against vandalism. In other embodiments, the lock 156 is a locking tab, to protect against accidental removal. When the knob 158 is rotated clockwise, the lock 156 is deployed into the position shown, to engage a corresponding slot (not shown) in the outer wall 110*a*. When the knob is rotated counterclockwise, the lock is retracted, allowing the base 120 to be removed. FIG. 22C shows the base of FIG. 22B with deodorizing inserts in the insert holders.

In some embodiments (FIGS. 16-18), one side wall 210*a* of the outer side walls 210*a*-210*d* has a hinged or sliding portion 250 near a bottom of the container 200, the hinged or sliding portion 250 having an open position (FIG. 18) for emptying the waste, and the base has a tapered surface 240 for directing the waste toward the bottom opening 222 when the hinged or sliding portion is in the open position. In FIGS. 16-18, the portion 250 is slidable. FIGS. 16-17 show the container 200 in the closed position.

In some embodiments, a container 100 (FIGS. 1-11) comprises a plurality of non-permeable outer side walls 110*a*-110*d* connected to form a tubular structure 111. One or more permeable inner walls 112*a*-112*b* are near respective ones of the plurality of outer walls 110*a*-110*d*, defining a respective space 114*a*, 114*b* between each inner wall 112*a* (112*b*) and its respective adjacent outer wall 110*d* (110*b*). A non-permeable lid 116 is provided for covering a top opening 118 of the tubular structure. A removable, permeable base 120 (FIG. 12) is provided at or near a bottom opening 122 of the tubular structure 111.

In some embodiments (e.g., FIG. 2), each of the one or more permeable inner walls 112*a*, 112*b* have perforations or slots.

In some embodiments (e.g., FIG. 12), the base 120 comprises a mesh material.

In some embodiments (e.g., FIG. 2), the base 120 has a plurality of perforations 119 or slots.

In some embodiments, the base 120 is removable, and two of the inner walls 112*a*, 112*b* have slots 124 (FIG. 2) for slidably receiving the base 120 therein.

In some embodiments (e.g., FIGS. 4, 6), at least two of the plurality of side walls 110*b*, 110*d* have bag holders 126 at or near a bottom end of the tubular structure, the bag holders adapted for holding a bag 128 (FIG. 29) open beneath the bottom end.

In some embodiments, the bag holders 126 include knobs, pegs, or hooks.

In some embodiments (FIGS. 3, 4), one of the outer side walls 110*c* has one or more mounting brackets 130 attached thereto.

In some embodiments (FIG. 5), one of the outer side walls 110*a* has a bag dispenser 132, 134 therein or thereon.

In some embodiments, the bag dispenser 132, 134 is detachable.

In some embodiments (FIG. 8), the one of the outer side walls 110*a* has a recess 136, 138 configured to receive the bag dispenser 132, 134.

In some embodiments (FIG. 8), the tubular structure 111 has one or more tapered surfaces 140, 142 at a bottom end of the tubular structure, for directing the waste when the container 100 is emptied.

Some embodiments (FIGS. 21B, 21C) further comprise at least one bracket 144 or mount for a removable odor management insert.

In some embodiments (FIGS. 21B, 21C), the bracket 144 or mount is part of, or attached to, the base 120.

Figure 23:
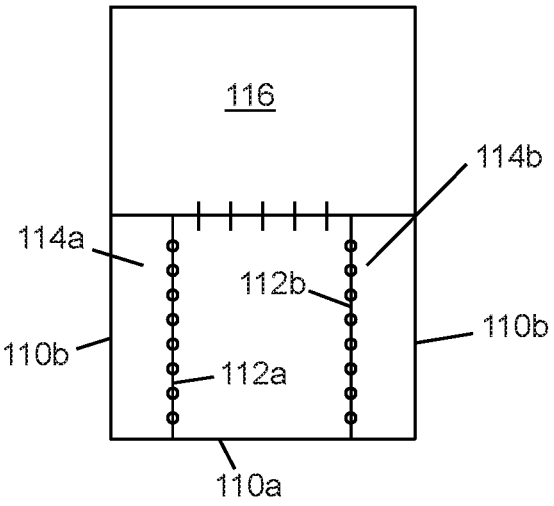
FIG. 23 shows a top view of the container of FIG. 1, with the lid opened.

In some embodiments (FIGS. 23, 24), the spaces 114*a*, 114*b* extend to the bottom 122 of the container 100, for continuously ventilating the container. For example, in some embodiments, the spaces 114*a*, 114*b* are about 2 inches (5 cm) on each side of the container 100. The corresponding base 230 can have mating openings on each side as shown for ventilating spaces 114*a*, 114*b*, or the base 230 can have slots or perforations on each side.

The exemplary embodiments have an all-weather design suitable for consumer use, with odor management and accessory management. The exemplary designs minimize handling of unsanitary waste. In some embodiments, the brackets 144 are configured to accommodate deodorizing inserts 145 having a non-permeable surface on the top of the insert (e.g., a plastic film), to prevent water or waste liquid from wetting the deodorizing agent. The odor inserts can also include citronella or another scent to keep away insects and/or other pests.

Figure 38:
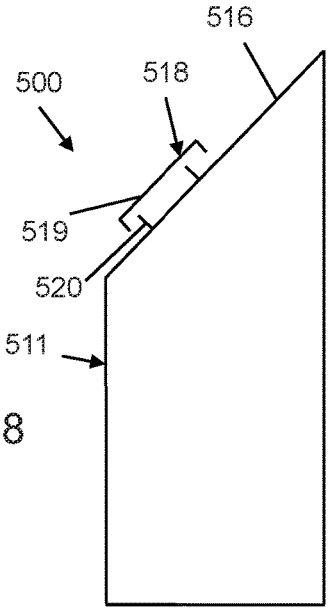
FIG. 38 is a side view of an embodiment of a container having a vented lid.
Figure 39:
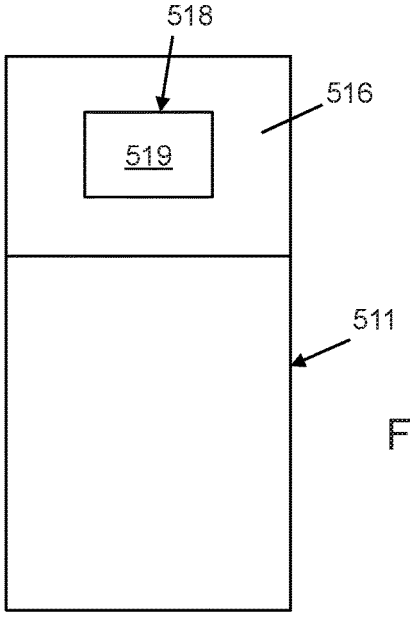
FIG. 39 is a front view of the container of FIG. 38.
Figure 40:
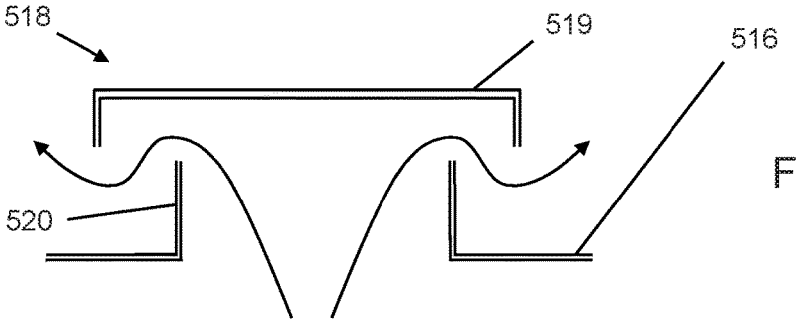
FIG. 40 is a cross-sectional view of the vent of FIG. 38.

In some embodiments, the lid is vented. FIGS. 38-40 show an embodiment of a container 500 having a vented lid 516. The body 511 of the container can be any of the bodies 111 described above. The lid 516 has a vent 518, comprising a vented side 520, which can have perforations, slots, or other openings. The sides 520 support a plate 519 which wraps around the sides 520, preventing rain infiltration, while permitting airflow.

Operation

In some embodiments, the body 111, lid 116, and base 120 are assembled (body assembly). In other embodiments, the body 111 is molded or extruded as a single unitary tubular structure. In some embodiments, the mounting brackets 130 are installed on the post 152 or wall, and the body assembly 100 is attached to the mounting brackets 130. Bagged pet waste is collected. The lid 116 is opened using the handle on the lid and then the waste is dropped into the body 111, falling down to rest on the base 120. The waste collects in the vented inner chamber of the body 111 until the device is evacuated. For evacuation, a bag 128 (e.g., a bag larger than the container) can be attached to the protrusions 126 extending from the exterior of body 111, holding the bag 128 open underneath the body. The handle of the base 120 is pulled, sliding the base 120 out of the cutout 113 in the body 111 and allowing the pet waste to fall downward into the collection bag 128 below. The base 120 is then reinserted once all waste has been removed. The collection bag 128 is then removed and can be tied and discarded.

In some embodiments, a method comprises: storing waste in a container 100 having non-permeable outer walls 110*a*-110*d*, a non-permeable lid 116, at least one permeable inner wall 112*a*, 112*b* and a permeable base 120; continuously ventilating the container 100 through the inner wall 112*a*, 112*b*; and continuously ventilating the container through the base 120.

In some embodiments, the method further comprises: attaching a bag 128 to the container 100, so the bag 128 is below the container 100; and removing the base 120 to permit the waste to fall into the bag 128.

In some embodiments, the container 100 has a plurality of hooks or knobs 126 at or near a bottom end of the container 100, the bag 128 is a shopping bag having a plurality of handles 129, and the attaching step includes hanging the handles 129 on respective ones of the plurality of hooks or knobs 126.

In some embodiments, the method further comprises inserting a bag dispenser 132, 134 containing a plurality of bags for receiving the waste into a recess in one of the outer walls. In some embodiments, the dispensers 132, 134 are pre-loaded. In some embodiments, the dispensers dispense bags 128 of different sizes, such as container sized bags, and individual use bags, which are used and disposed of in the container 100.

In some embodiments (FIGS. 20A-22C, 25, 26), the method further comprises inserting an odor management insert 145 into a bracket 144 or mount on a bottom surface of the base 120.

FIGS. 41-48B show another exemplary embodiment of a waste container 600. The container 600 has a double walled construction, including an outer container 602 and an inner container 620 (best seen in FIGS. 44-45). The outer container 602 and the inner container 620 can be made from one or more materials, such as but not limited to Acrylonitrile butadiene styrene (ABS), high-density polyethylene (HDPE), polyvinyl chloride (PVC), mineral composite HDPE (such as "BEAR BOARD" mineral composite HDPE sold by Engineered Plastic Systems, LLC of Elgin, Ill.), wood, wood composite. The inner container 620 can be made from one or more materials, such as but not limited to aluminum, galvanized aluminum, stainless steel, copper, ABS, HDPE or PVC or mineral composite HDPE.

Figure 42:
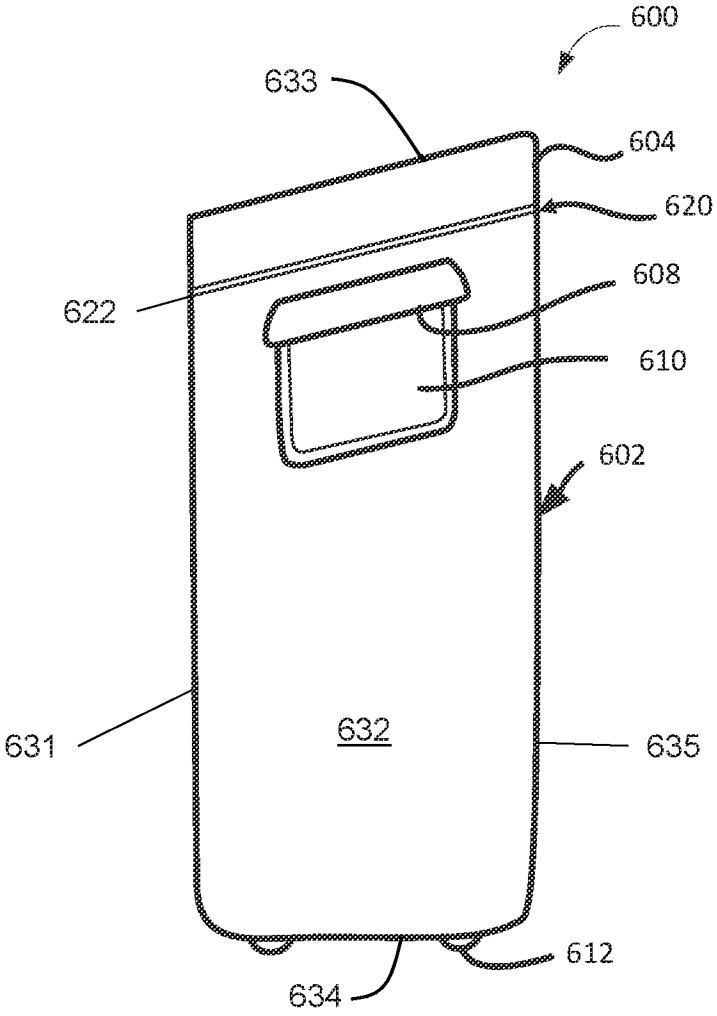
FIG. 42 is a side view of the container of FIG. 41.
Figure 41:
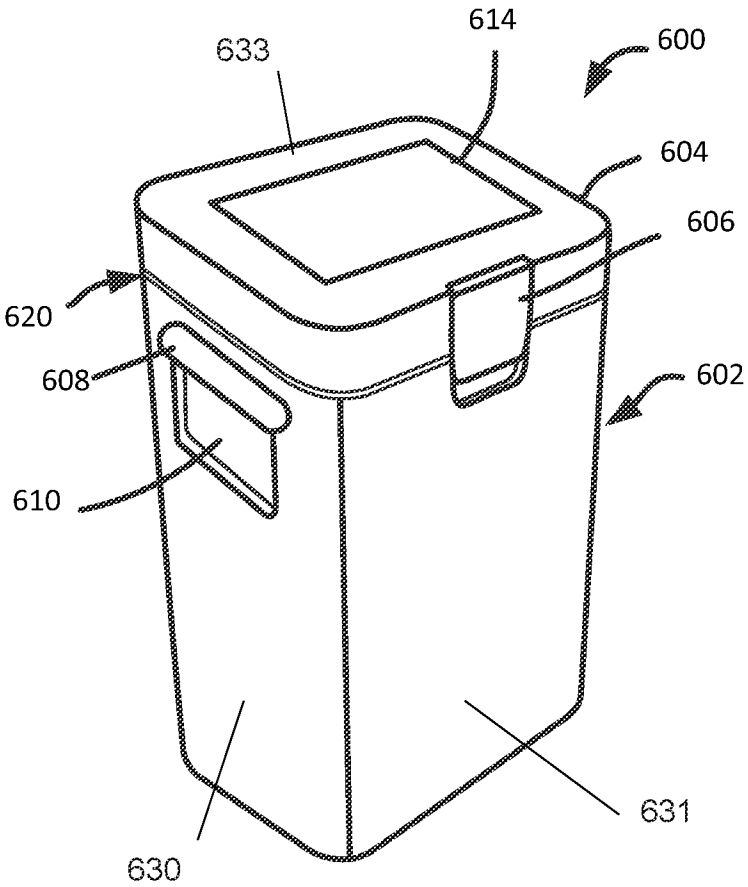
FIG. 41 is an isometric view of an embodiment of a container.

The outer container 602 has six faces: front face 631, back face 634, side faces 630 and 632, a lid 633, and a bottom 634. In some embodiments, the back face 635 has a height greater than a height of the front face 631, and the side faces 630 and 632 are trapezoidal in shape, as best seen in FIG. 42. In other embodiments, the front face 631 and back face are the same size as each other, the side faces 630 and 632 are the same sizes as each other, and the outer container 602 has a rectangular parallelepiped shape. The side walls of the outer container 602 can be permeable or non-permeable material. In some embodiments, one or more walls of the outer container are permeable, and one or more walls of the outer container are non-permeable.

The lid 633 of the outer container 602 has a closure, such as a latch 606, to prevent accidental spillage, and to prevent small children and/or animals from opening the outer container. In some embodiments, the closure has a lock, or a hasp that can be secured with a padlock. A variety of alternative closures can be used, such as, but not limited to, barrel, hook and eye, hook and loop, or the like. Each side face 630, 632 can have a respective handle 608 and an indented recess 610 beneath the handle 608, for ease of handling. In some embodiments, the lid 633 is attached to the outer container 602 by one or more hinges. In other embodiments, the lid 633 is attached to the outer container 602 by a unitary "living" hinge. In other embodiments (not shown), the inner container has a vertical lip, and the lid 633 fits over the vertical lip with or without any hinge attachment. In this embodiment the lid may or may not secure to the container.

Figure 46:
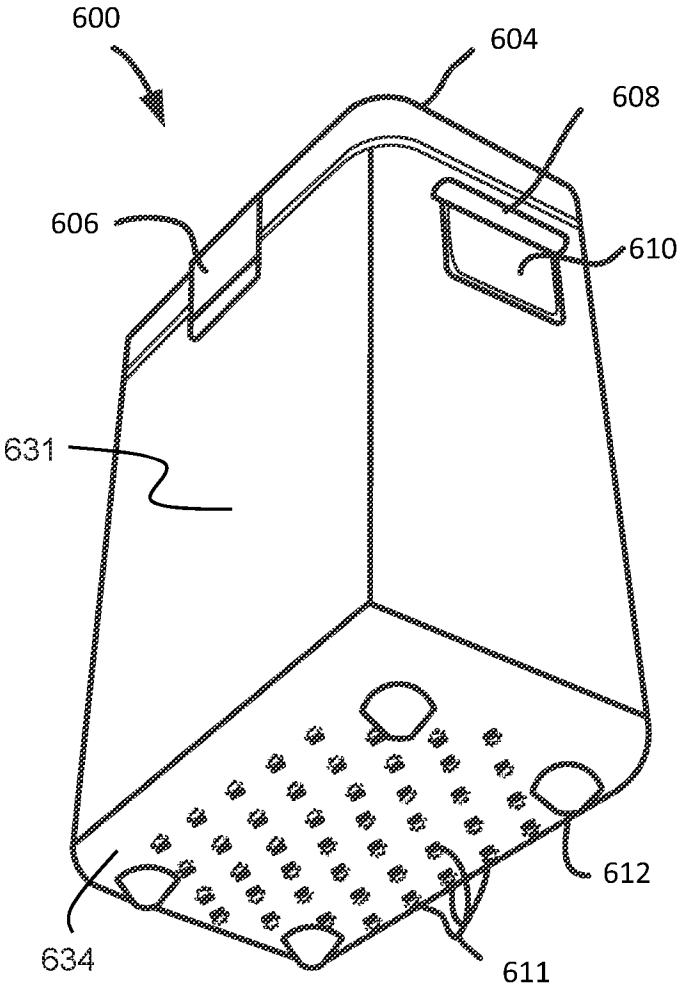
FIG. 46 shows vents in the bottom of the container of FIG. 41.

The outer container has at least one vented side. In some embodiments, as shown in FIG. 46, the bottom face 634 has a plurality of vents 611. The vents 611 can be circular holes, or the vents can have an ornamental shape, such as a shape of a dog's paw, as shown. In embodiments having vents on the bottom face 634, the outer container may or may not have a plurality of legs 612 to elevate the bottom surface 634, to facilitate ventilation.

Figure 47:
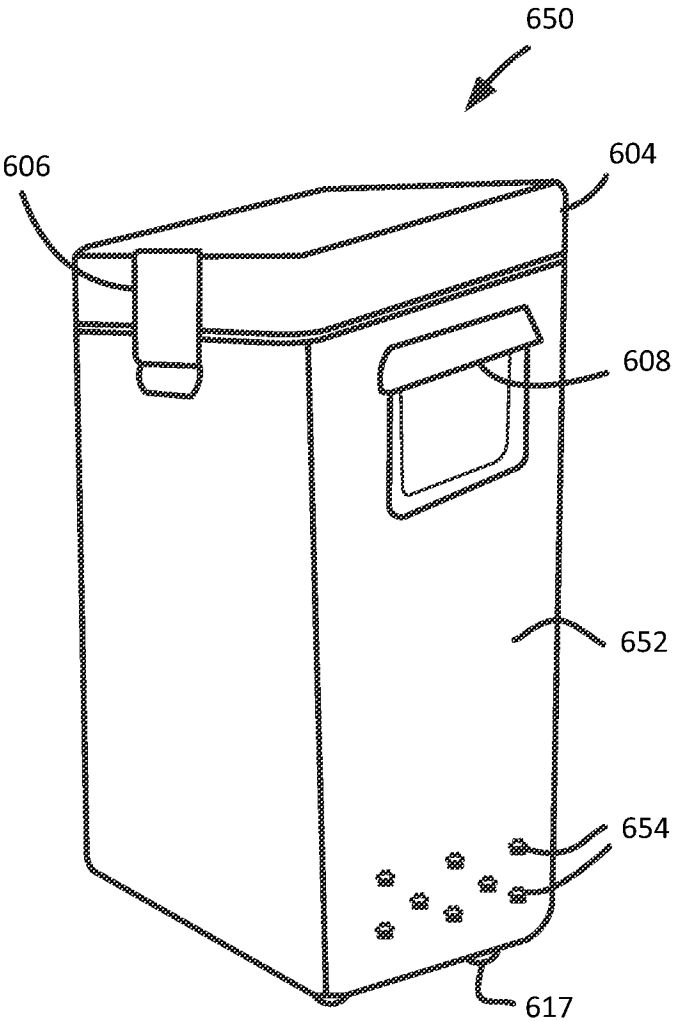
FIG. 47 shows an alternative arrangement in which the vents are formed on one or more side walls of the container.

FIG. 47 shows an embodiment of a container 654 in which one or more of the faces 652 have vents 654, which can be circular holes, or the vents can have an ornamental shape, such as a shape of a dog's paw, as shown. The vents 654 can be located on all or part of the face 654. In some embodiments, the vents 656 are located near the bottom of the side faces 652, as shown.

Figure 43:
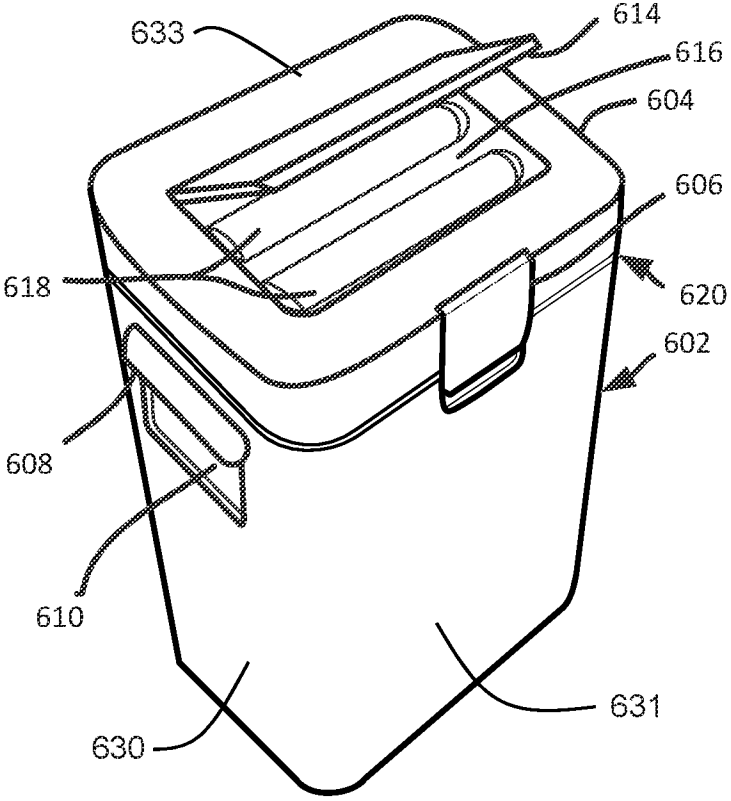
FIG. 43 shows a compartment in the lid of the container of FIG. 41.

In some embodiments, the lid 633 has a compartment 616 with a door 614, as shown in FIG. 43. The compartment 616 can be accessed (from outside the container) by opening the door 614, without opening the lid 633 of the container 600. The compartment 616 can store a variety of accessories, such as disposable bags, or deodorant in a variety of forms (e.g., cake, pellets, powder, gel, liquid or aerosol). In the embodiment of FIG. 43, the compartment 616 has one or more mounting brackets 637 (FIG. 49) for rotatably mounting spools 618 for holding and dispensing disposable sanitary plastic or paper bags. In some embodiments, the bags are plastic, may be biodegradable, durable and leak proof. For example, the bags can be made of polyethylene, polypropylene or polystyrene, treated with an additive to shorten the life of the plastic (e.g., "D2W" additive, sold by Symphony Environmental Technologies, PLC, Hertfordshire, UK or Totally Degradable Plastic Additives ("TDPA®") sold by EPI Environmental Products Inc.).

Figures 48, 48A, 48B:
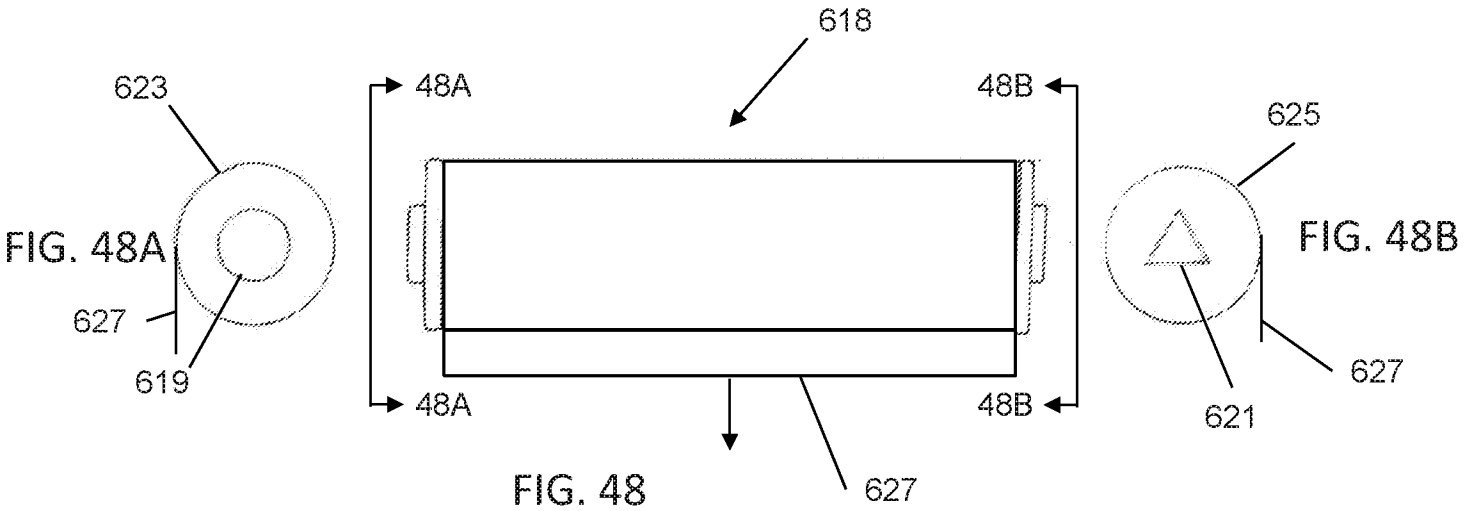
FIG. 48 shows a spool for dispensing bags for use in the container of FIG. 41.
FIG. 48A is a left side view of the spool of FIG. 48, taken along line 48A-48A of FIG. 48.
FIG. 48B is a left side view of the spool of FIG. 48, taken along line 48B-48B of FIG. 48.

FIGS. 48, 48A and 48B show an example of a spool 618 for holding a roll of bags 627. Each spool 618 has end caps 623, 625 that mount to the brackets (not shown) on each side of the compartment 616. In some embodiments, the door 614 has one or more slots (not shown), positioned to allow the bags 627 to be fed through the slot while the door 614 is closed. In other embodiments, the door is without slots, and the user opens the door each time a bag is to be removed. In some embodiments, the brackets are different from each other, and the end caps 623, 625 of the central spools 618 are different from each other, with the end caps 623, 625 configured to mate with respective brackets on each side of the spool 618. The spool can include ornamental features, such as, but not limited to, the circular protuberance 619 on end cap 623 and/or the triangular protuberance 621 on end cap 625. In some embodiments, each spool 618 can have a respectively different type of bag (e.g., small and large sizes, scented and unscented bags, regular and extra strength bags, etc. The brackets can have bearings to allow rotation of the spools 618 while mounted in the brackets, for dispensing the bags.

In some embodiments, the spool 618 is a unitary body, and the brackets (not shown) include bearings (not shown) to allow the spool to rotate about its axis while loading or dispensing bags. The bearings allow the central spool to rotate relative to the spool 618 to rotate, for loading or dispensing bags. The bags are loaded or dispensed by rotating the spool.

In other embodiments (not shown), the spool 618 has internal bearings, and the brackets (not shown) have fixed openings. The bearings in the spool allow the central spool to rotate relative to the end caps 623, 625, the round protuberance 629 and the triangular protuberance 621, for loading or dispensing bags.

In some embodiments, the spool is sold fully loaded with plastic bags 627. In other embodiments, the user can manually load bags on an the spool 618, either by rotating the spool within the compartment 616, or by removing the spool from the compartment and loading the bags outside of the compartment.

Figure 44:
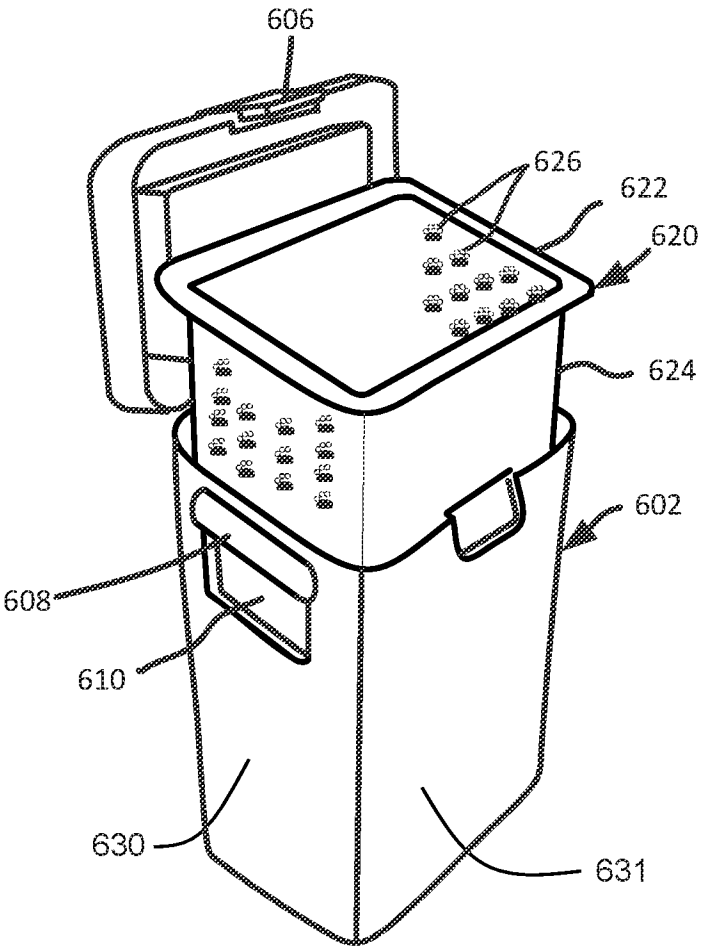
FIG. 44 shows the inner container inside the container of FIG. 41.
Figure 45:
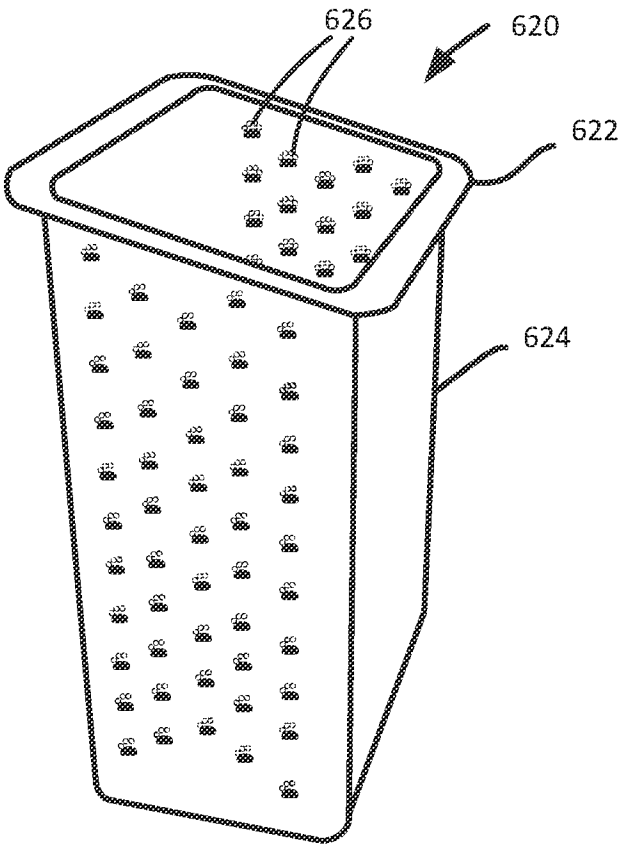
FIG. 45 is an isometric view of the inner container of FIG. 44.
Figure 49:
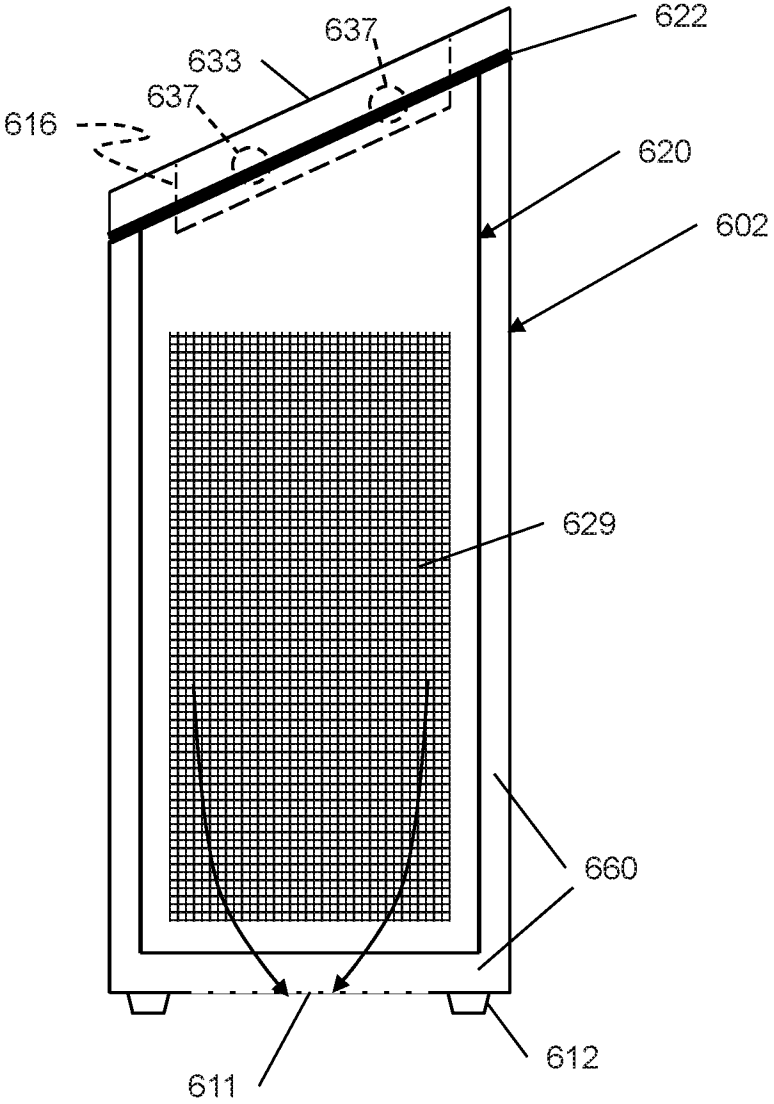
FIG. 49 is a schematic side view showing the channel between the inner container and the outer container.

FIGS. 44 and 45 show the inner container 620. The inner container 620 has a receptacle 624 and a rim 622. The rim 622 is sized and shaped to seat snugly between the top edge of the outer container 602 and the bottom of the lid 633, as shown in FIG. 43. The height of each face of the inner container 620 is less than or equal to a height of the corresponding side faces 630, 631, 632 and 635 of the outer container 602, so the inner container 620 fits inside the outer container 602 with the lid 633 closed and the closure 606 engaged. In some embodiments, the inner container 620 is shorter than the outer container 602, so the inner container 620 hangs from the top edge of the outer container 602. In some embodiments, the inner container 620 is sized so there is about a 1" (2.5 cm) channel 660 (e.g., from 0.75" to 1.25") between the inner container 620 and outer container 602, on the side faces and the bottom face, as shown in FIG. 49. This channel 660 ventilates the inner container 620, and allows the odors from the inner container to descend to the openings 611 in the bottom of the outer container 602.

The inner container 620 has at least one vented face 624. In some embodiments, as shown in FIG. 45, the side face 624 has a plurality of vents 626. The vents 626 can be circular holes, or the vents can have an ornamental shape, such as a shape of a dog's paw, as shown. The vents can be on one or more of the front, back, left, right or bottom sides. The vents 626 can be located on part or all of the vented side(s). For example, FIG. 45 shows an inner container 620 having vents 626 on the left and right side faces.

In some embodiments, the vented sides 624, 634, or 652 on either or both of the inner container 620 and/or the outer container 602 are covered with mesh, netting or screen cloth 629 (FIG. 49) to prevent insects from entering the containers. In some embodiments, the screen cloth 629 can be stainless steel, fiberglass or extruded vinyl coated polyester screening, or ultraviolet (UV) blocking screen or other materials. The screen cloth 629 can be placed on the inside and/or outside of the faces of the inner container 620 and/or outer container 602. In operation, the container 600 or 650 can be located on a floor. The height of the lid 633 can be conveniently set at from about 15" to about 30" (38 cm to 76 cm) above the floor. In some embodiments, the height of the lid 633 is from about 18" to about 22" (45 cm to 56 cm) above the floor. At this height, with the lid 633 open, the user can conveniently lift and remove a filled bag 627 inside the container and install a new empty bag 627 in its place. The open end of the bag can be wrapped around the rim 622 of the inner container 620. Periodically, the user can also remove the inner container 620 from the outer container for cleaning. The user can grip the rim 622 of the inner container 620, and lift the inner container 620 out from the outer container 602 for cleaning.

In various embodiments, the container 600 can have an odor masking or absorbing insert (e.g., a charcoal filter) inside the outer container 602 or outside of the inner container 620 (between the outer and inner containers), inside the compartment 616, under the compartment 616 or under the lid. In some embodiments, either or both of the inner and outer containers 620, 602 includes a plastic additive to minimize odor.

Figure 51:
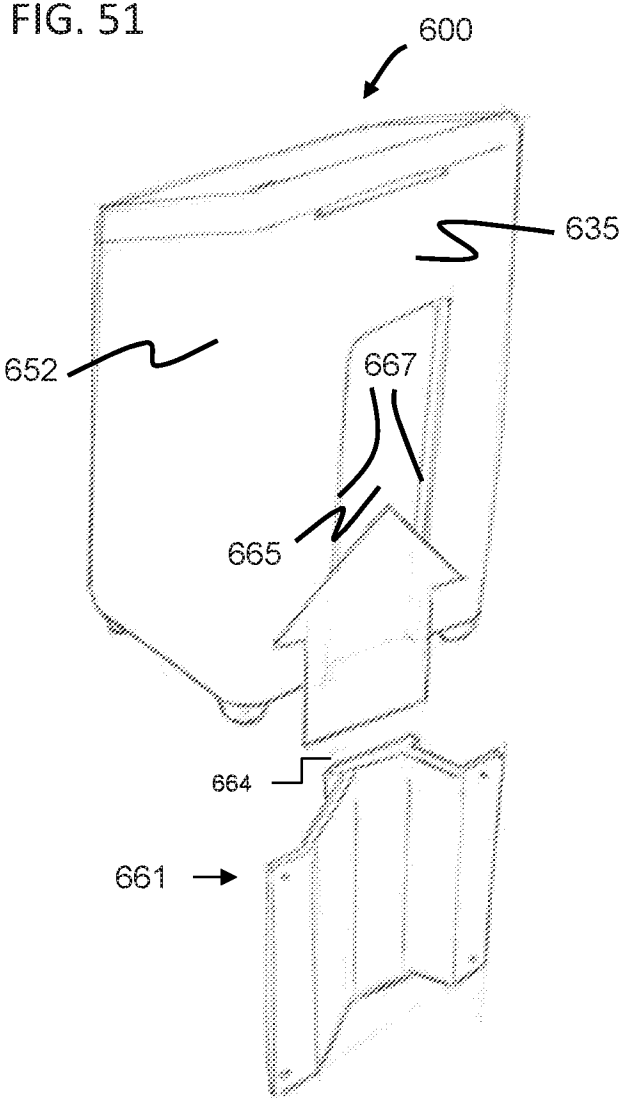
FIG. 51 shows the mounting plate fitting into a receptacle on the back of the container.
Figure 50:
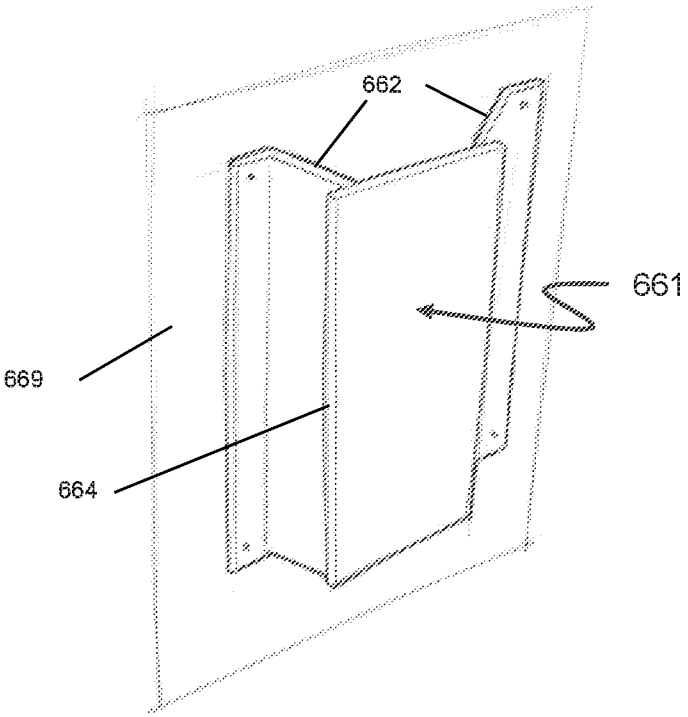
FIG. 50 shows a mounting plate for the container of FIG. 41.

FIGS. 50 and 51 show an example of a mount 661 that can be used for mounting the container 600 above a floor or other surface. The mounting mechanism can comprise a single fixation point or multiple fixation points. For example, the mounting bracket 661 includes a plate 664 that is mounted to a wall 669, pole, or other vertical surface by two standoffs 662. The standoffs 662 can be attached to the wall, pole the like or by any of a variety of fasteners including, but not limited to, nails, screws, bolts or the like. The back face 635 of the container 600 has a complementary receptacle 665 configured to receive the plate 664. For example, the receptacle 665 can be a recess having a channel or groove on at least two sides that is sized and shaped to receive the plate 664. In some embodiments, the plate 664 has a friction fit in the channel. The mounting bracket 661 can have a mechanism to secure or lock the bracket 661 and receptacle 665 together. The recess 665 can extend all the way to the bottom of the container 600, so the receptacle 665 can slide down over the plate (for a fixed plate) or the plate can slide up into the receptacle as shown (for a plate mounted to a pole, before the pole is implanted on the ground or mounted on a stand). Although the plate 664 is shown as rectangular, the plate can have any of a variety of shapes including, but not limited to, a circle or triangle.

Although the subject matter has been described in terms of exemplary embodiments, it is not limited thereto. Rather, the appended claims should be construed broadly, to include other variants and embodiments, which may be made by those skilled in the art.

What is claimed is:

1. A container comprising:

a tubular structure comprising an interior adapted for receiving waste;

a lid for covering a top opening of the tubular structure, wherein the lid comprises an integrated compartment with a bag dispenser therein, the lid comprising a sub-lid for accessing the integrated compartment while the lid is in contact with a top edge of the tubular structure; and a base at or near a bottom opening of the tubular structure, wherein the integrated compartment is adapted to store bags separate from the interior of the tubular structure.

2. The container of claim 1, wherein the tubular structure comprises a side wall that comprises a vent or a plurality of vents.

3. The container of claim 2, wherein the side wall further comprises mesh, netting, or screen cloth covering the vent or the plurality of vents.

4. The container of claim 1, wherein the base has a plurality of perforations or slots.

5. The container of claim 1, wherein the lid is attached to the tubular structure with one or more hinges.

6. The container of claim 5, further comprising a fastener for securing the lid to a side wall of the tubular structure opposite a portion of the side wall having the lid attached thereto.

7. The container of claim 1, wherein the tubular structure comprises one or more mounting brackets attached thereto.

8. The container of claim 7, wherein the one or more mounting brackets is attached to an outer surface of the tubular structure for attaching the container to a structure such that the container is located above a ground surface.

9. The container of claim 1, wherein the bag dispenser is detachable.

10. The container of claim 1, further comprising a removable inner container.

11. The container of claim 10, wherein the inner container comprises four side walls and a bottom wall.

12. The container of claim 1, wherein the lid further comprising at least one bracket or mount for a removable odor management insert.

13. The container of claim 12, wherein the bracket or mount is part of, or attached to, an underside of the lid.

14. A container comprising:

a tubular structure comprising an outer surface and an interior adapted for receiving waste;

at least one mount attached to the outer surface for attaching the container to a structure with the container located above a ground surface;

a lid for covering a top opening of the tubular structure; wherein the lid comprises an integrated compartment with a bag dispenser therein, the lid comprising a sub-lid for accessing the integrated compartment while the lid is in contact a top edge of the tubular structure; and a base at or near a bottom opening of the tubular structure, wherein the integrated compartment is adapted to stre bags separate from the interior of the tubular structure.

15. The container of claim 14, wherein the bag dispenser is detachable.

16. The container of claim 14, further comprising a removable inner container.

17. The container of claim 14, wherein the lid further comprising at least one bracket or mount for a removable odor management insert.

18. The container of claim 14, wherein the lid is attached to a side wall with one or more hinges.

19. The container of claim 1, wherein the integrated compartment is adapted for storing a cylindrical roll of bags.

20. The container of claim 1, wherein the sub-lid can move between a closed position where the integrated compartment is inaccessible from a top side of the lid and an open position where the integrated compartment is accessible from the top side of the lid.

* * * * *